US007218083B2

(12) United States Patent
Wang et al.

(10) Patent No.: US 7,218,083 B2
(45) Date of Patent: May 15, 2007

(54) LOW DROP-OUT VOLTAGE REGULATOR WITH ENHANCED FREQUENCY COMPENSATION

(75) Inventors: Wei Wang, Shanghai (CN); XiaoHu Tang, Shanghai (CN); XiaoHua Hou, Shanghai (CN)

(73) Assignee: O2Mincro, Inc., Grand Cayman (KY)

( * ) Notice: Subject to any disclaimer, the term of this patent is extended or adjusted under 35 U.S.C. 154(b) by 0 days.

(21) Appl. No.: 11/135,180

(22) Filed: May 23, 2005

(65) Prior Publication Data

US 2006/0192538 A1 Aug. 31, 2006

Related U.S. Application Data

(60) Provisional application No. 60/656,732, filed on Feb. 25, 2005.

(51) Int. Cl.
*G05F 1/00* (2006.01)

(52) U.S. Cl. ..... 323/273

(58) Field of Classification Search ..... 323/273, 323/280, 281; 327/538, 540
See application file for complete search history.

(56) References Cited

U.S. PATENT DOCUMENTS 5,334,928 A * 8/1994 Dobkin et al. ..... 323/280
5,373,225 A * 12/1994 Poletto et al. ..... 323/282
5,867,015 A 2/1999 Corsi et al.
6,304,131 B1 10/2001 Huggins et al.
6,518,737 B1 2/2003 Stanescu et al.
6,603,292 B1 * 8/2003 Schouten et al. ..... 323/277
6,636,025 B1 * 10/2003 Irissou ..... 323/313
6,703,815 B2 3/2004 Biagi
6,972,974 B2 * 12/2005 Inn et al. ..... 363/89
6,975,099 B2 * 12/2005 Wu et al. ..... 323/280
2005/0242796 A1 * 11/2005 Yang et al. ..... 323/282

OTHER PUBLICATIONS

Active Capacitor Multiplier in Miller-Compensated Circuits, Gabriel A. Rincon-Mora, IEEE Transactions on Solid-State Circuits, vol. 35, No. 1, Jan. 2000, 7 Pages.

* cited by examiner

*Primary Examiner*—Adolf Berhane
(74) *Attorney, Agent, or Firm*—Carlton Fields; Li K. Wang, Esq.

(57) ABSTRACT

The present invention is a voltage regulator circuit with enhanced frequency compensation. The voltage regulator includes an error amplifier, a dynamic bias circuit, an enhanced frequency compensation unit, a pass device and a compensation circuit. A signal from the pass device acts as an input signal of the error amplifier and is compared with another input signal, producing a differential signal. The differential signal is amplified and then provided to the dynamic circuit and the enhanced frequency compensation unit. The enhanced frequency compensation unit is provided such that a zero reference value in a left-hand plane can be generated to optimize the compensation for the voltage regulator circuit. The error amplifier includes a capacitor for compensating an output voltage of the voltage regulator circuit.

26 Claims, 8 Drawing Sheets

LOW DROP-OUT VOLTAGE REGULATOR WITH ENHANCED FREQUENCY COMPENSATION

RELATED APPLICATION

This application claims the benefit of U.S. provisional application, titled Enhanced Compensation Strategy for Low Quiescent Current, Low Drop-out Voltage Regulator, Ser. No. 60/656,732, filed on Feb. 25, 2005, the specification of which is incorporated herein in its entirety by this reference.

BACKGROUND OF THE INVENTION

1. Field of the Invention

The present invention relates to voltage regulators and in particular, to a low drop-out voltage regulator with low power dissipation.

2. Description of the Related Art

Currently, the increasing demand for higher performance power supply circuits has resulted in a continued development of voltage regulator devices. Many low voltage applications, such as for use in cell phones, pagers, laptops, camera recorders and other mobile battery operated devices, require the use of low drop-out (LDO) voltage regulators. These portable electronics applications typically require low voltage and small quiescent current flow to increase the battery efficiency and longevity.

The LDO voltage regulators generally can provide a well-specified and stable DC voltage whose input to output voltage difference is low. The LDO voltage regulators are usually configured for providing the power requirements to electrical circuits. The LDO voltage regulators typically have an error amplifier, a dynamic bias circuit and a pass device, e.g., a power transistor. These three components are coupled in series. The error amplifier is coupled to an input terminal of the LDO voltage regulators, and the pass device is coupled to an output terminal of the LDO voltage regulators. The dynamic bias circuit is configured to drive the pass device, which can then drive an external load.

In general, a feedback circuit is further provided to the LDO voltage regulators scaling the output voltage down and feeding back a scaled down voltage to the error amplifier. The negative feedback provided by the feedback circuit can improve the stability of the regulator system. The LDO voltage regulators can further incorporate a compensation circuit to form a control loop and provide Miller compensation in order to improve the stability of the LDO voltage regulators. A conventional technique for providing Miller compensation is to take advantage of the Miller Effect, by adding a Miller compensation circuit or a nested Miller compensation (NMC) circuit which includes a Miller compensation capacitor. The Miller compensation capacitor is inserted between the output voltage and the error amplifier. Such a configuration may result in a well-known phenomenon called pole splitting, which advantageously multiplies the effective capacitance of the physical capacitor used in the circuit. However, the Miller compensation capacitor may cause the two poles to meet together, and then generate two complex poles in a right-hand plane along a direction, especially when the LDO voltage regulator covers a larger range of a capacitive load with an equivalent serial resistance (ESR) and provides a large output current. The right-hand plane poles can cause voltage oscillation at the LDO voltage regulators, which will make the output voltage unstable.

It is thus desirous to have an apparatus and method that can provide a stable output voltage when the capacitance of a load varies in a larger range, and at the same time output a corresponding current with low power dissipation, high driving capacity, and good stability. It is to such an apparatus and method the invention is primarily directed to.

SUMMARY OF THE INVENTION

In one embodiment, the invention is a LDO voltage regulator circuit with enhanced frequency compensation. The LDO voltage regulator circuit includes an error amplifier for generating an amplified error voltage, a dynamic bias circuit, an enhanced frequency compensation unit for generating a zero reference value, a pass device for providing an output voltage to drive a plurality of external components, and a feedback circuit for scaling down the output voltage. The LDO voltage regulator circuit further includes a compensation circuit for providing compensation to the output voltage. The error amplifier has a first input terminal for receiving a reference voltage, a second input terminal for receiving a feedback voltage, a third input terminal, and an output terminal. The dynamic bias circuit has an input terminal and an output terminal, and the input terminal of the dynamic bias circuit is connected to the output terminal of the error amplifier. The enhanced frequency compensation unit has a first terminal and a second terminal, and the first terminal of the enhanced frequency compensation unit is connected to the output terminal of the error amplifier. The pass device has an input terminal and an output terminal, and the input terminal of the pass device is connected to the output terminal of the dynamic bias circuit. The feedback circuit has a first terminal and a second terminal, the first terminal of the feedback circuit is connected to the output terminal of the pass device, and the second terminal of the feedback circuit is connected to the second input terminal of the error amplifier.

In another embodiment, the invention is a LDO voltage regulator circuit with enhanced frequency compensation. The LDO voltage regulator circuit includes an error amplifier for generating an amplified error voltage, a dynamic bias circuit, an enhanced frequency compensation unit for generating a zero reference value, a pass device for providing an output voltage to drive a plurality of external components, and a feedback circuit for scaling down the output voltage. The LDO voltage regulator circuit further includes a compensation circuit for providing compensation to the output voltage. The error amplifier has a first input terminal for receiving a reference voltage, a second input terminal for receiving a feedback voltage, a third input terminal, and an output terminal. The dynamic bias circuit has an input terminal and an output terminal, and the input terminal of the dynamic bias circuit is connected to the output terminal of the error amplifier. The enhanced frequency compensation unit has a first terminal and a second terminal, and the first terminal of the enhanced frequency compensation unit is connected to the output terminal of the dynamic bias circuit. The pass device has an input terminal and an output terminal, and the input terminal of the pass device is connected to the output terminal of the dynamic bias circuit. The feedback circuit has a first terminal and a second terminal, the first terminal of the feedback circuit is connected to the output terminal of the pass device, and the second terminal of the feedback circuit is connected to the second input terminal of the error amplifier.

In yet another embodiment, the invention is a method for frequency compensation in a low drop-out voltage regulator circuit with enhanced frequency compensation capacity. This method includes the steps of generating an amplified voltage, receiving the amplified voltage at a dynamic bias circuit, generating a first output voltage at the dynamic bias circuit, driving a pass device with the first output voltage, increasing a slew rate for a gate voltage of the pass device through use of the dynamic bias circuit, receiving a second output voltage from the pass device, generating a zero reference value to stabilize the second output voltage, and regulating a damping factor to further stabilize the second output voltage.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION OF THE INVENTION

Figure 1:
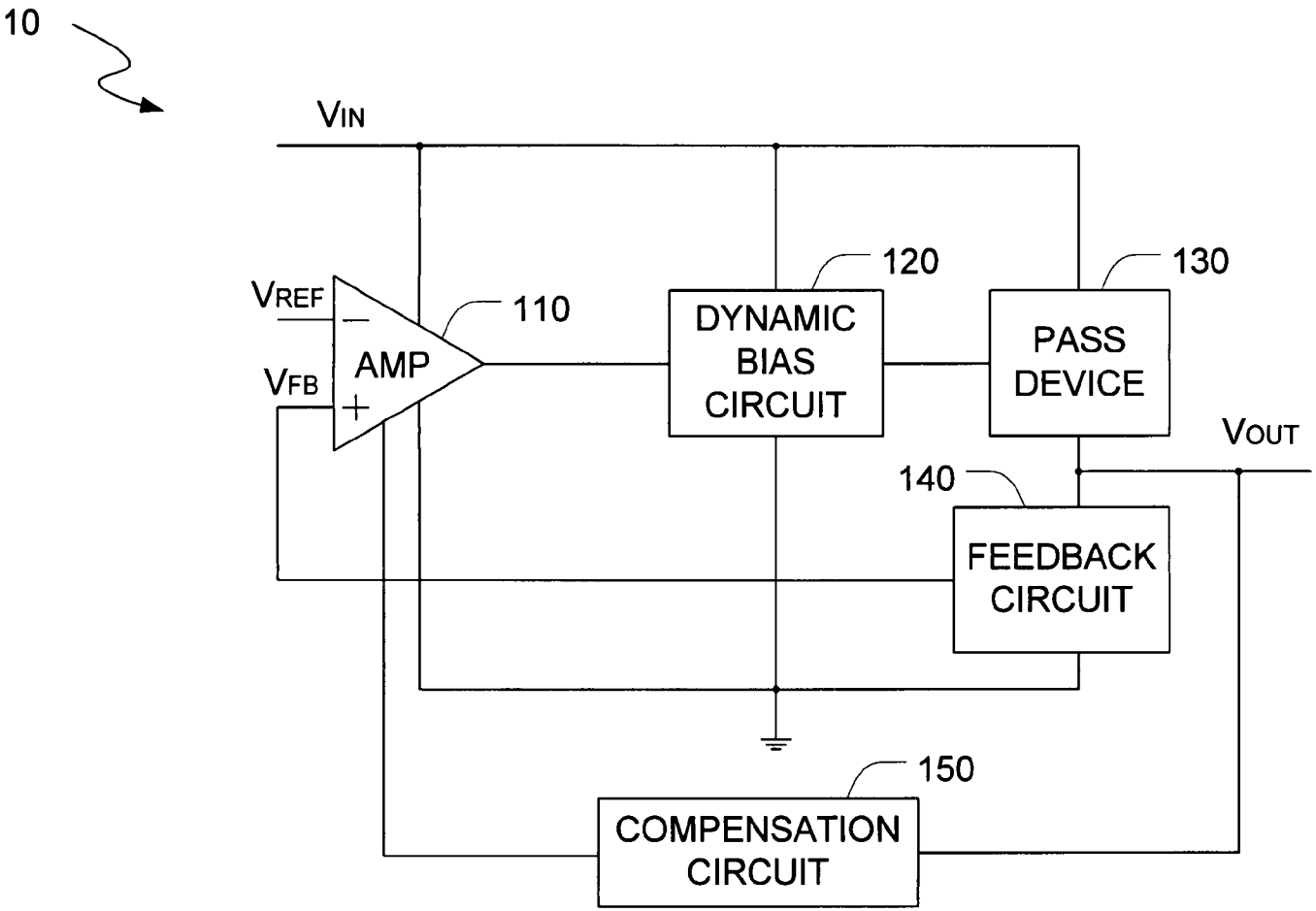
FIG. 1 PRIOR ART
FIG. 1 is a block diagram of a prior art low drop-out voltage regulator.

FIG. 1 illustrates a block diagram of a prior art LDO voltage regulator 10 with Miller compensation. Traditionally, the voltage regulator 10 includes an error amplifier 110, a pass device 130, a feedback circuit 140, and a compensation circuit 150. The voltage regulator 10 can further include a dynamic bias circuit 120 to increase the response speed of the LDO structure through enlarging the slew rate for a gate voltage of a MOS transistor incorporated in the pass device 130. A power supply voltage $V_{IN}$ is provided to the error amplifier 110, the dynamic bias circuit 120, and the pass device 130, respectively. The pass device 130 can provide an output voltage $V_{OUT}$ at an output terminal to an external load (not shown).

The error amplifier 110 can amplify a differential value between two input signals and then output the amplified value at its output terminal. A first signal, for example, a predetermined reference voltage $V_{REF}$ is provided to an inverting input terminal of the error amplifier 110, and a second signal $V_{FB}$ from the feedback circuit 140 is transmitted back to a non-inverting input terminal of the error amplifier 110. The differential value is given by the second signal $V_{FB}$ subtracted from the first signal $V_{REF}$, and then the amplified value is provided to the dynamic bias circuit 120.

The dynamic bias circuit 120 may include a PMOS transistor as a source follower which is coupled to the output terminal of the error amplifier 110. The dynamic bias circuit 120 usually consists of a plurality of MOS transistors. The dynamic bias circuit 120 provides an output voltage to the pass device 130 and drives the action of the pass device 130. The dynamic bias circuit 120 can increase the slew rate for the voltage of a gate terminal of the MOS transistor included in the pass device 130.

The pass device 130 is driven by the output voltage from the dynamic bias circuit 120, and provides an output voltage $V_{OUT}$ to the external load as an effective power supply with a desirable output current (not shown). The feedback circuit 140 can scale the output voltage $V_{OUT}$ based on a specific proportion, which depends on a topology of the voltage regulator 10. The feedback circuit 140 may feedback the scaled voltage, for example $V_{RB}$ to the error amplifier 110. The compensation circuit 150 can provide a capacitive compensation depending on various conditions of the external load so that the output voltage $V_{OUT}$ can be kept relatively stable.

Figure 2:
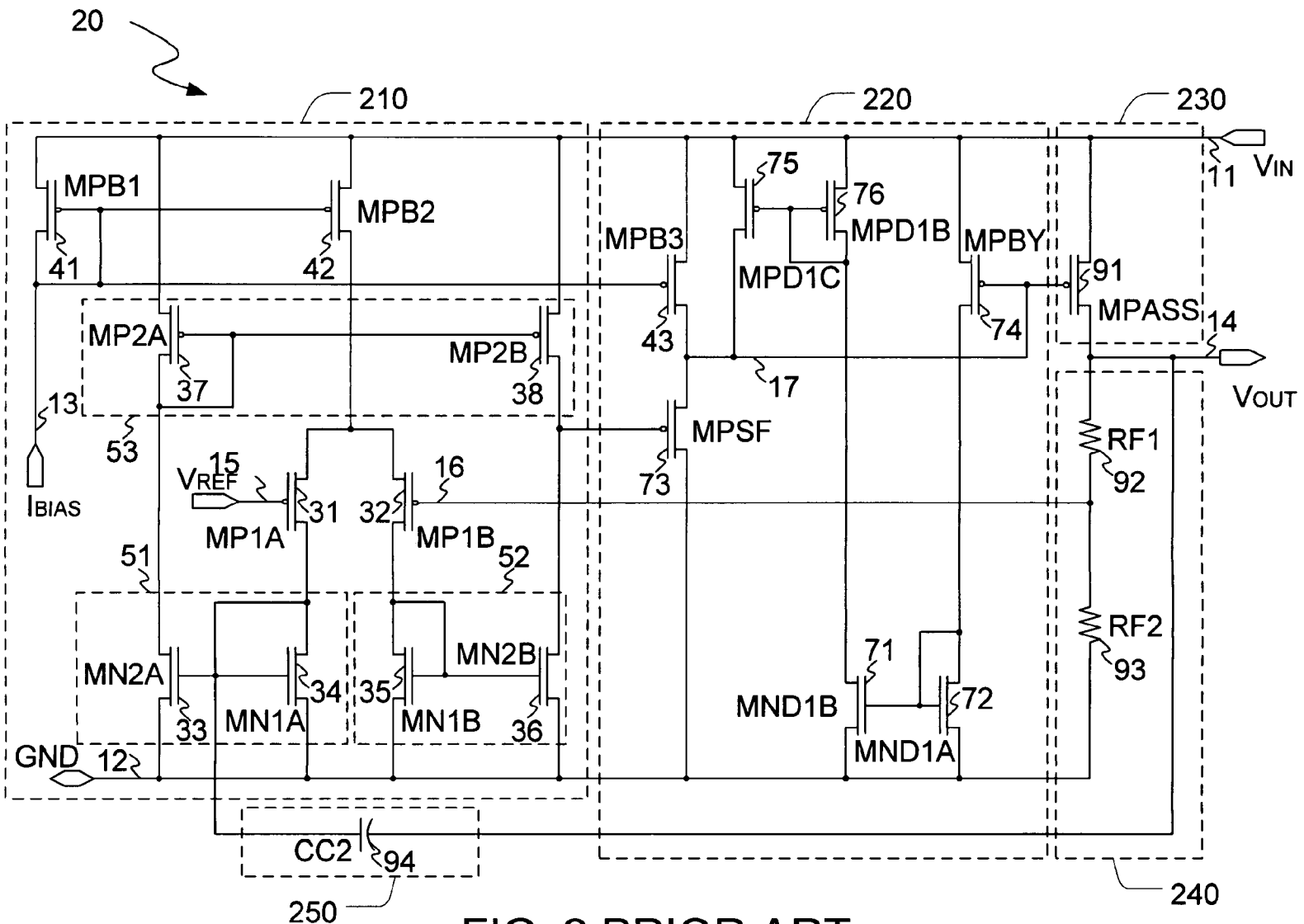
FIG. 2 PRIOR ART
FIG. 2 is a schematic diagram of a prior art LDO voltage regulator of FIG. 1.

FIG. 2 illustrates a schematic diagram of an exemplary implementation 20 of the prior art voltage regulator 10 of FIG. 1. In this embodiment 20, the voltage regulator can operate in low quiescent power dissipation conditions, for example, all quiescent currents are less than 10 uA when an output current, $I_{OUT}$ (not shown), on an output rail 14 is zero. The voltage regulator includes an error amplifier 210, a dynamic bias circuit 220, a pass device 230, a feedback circuit 240, and a compensation circuit 250. A power supply $V_{IN}$ is provided to the error amplifier 210, the dynamic bias circuit 220, and the pass device 230 between a supply rail 11 and a ground rail 12. A sinking bias current $I_{BIAS}$ from a current source (not shown) is provided on an input rail 13. The pass device 230 outputs an output voltage $V_{OUT}$ to drive an external load (not shown) on the output rail 14.

In the error amplifier 210, differential input signals on line 15 and line 16 are provided to respective gate terminals of a differential pair of PMOS transistors 31, 32. PMOS transistors 41 and 42, 41 and 43 can form two separate current mirrors. The PMOS transistor 41 can establish an internal bias voltage based on the input bias current $I_{BIAS}$ on line 13. The transistors 42 and 43 can be biased by the bias voltage. The mirrored bias current in the PMOS transistor 42 can activate the PMOS transistors 31 and 32. Receiving the voltage $V_{REF}$ and $V_{RB}$ at lines 15 and 16, the differential pair of the PMOS 31 and 32 can begin to operate. Similarly, the current in the PMOS transistors 31 and 32 can activate NMOS transistors 34 and 35, respectively. Because NMOS transistors 34 and 35 is incorporated into current mirrors 51 and 52, the currents in the NMOS transistors 34 and 35 can be also mirrored, respectively, by NMOS transistors 33 and 36 in the same way as the PMOS transistor 42. The current in the NMOS transistors 33 and 36 can also activate PMOS transistors 37 and 38, respectively. The PMOS transistors 37 and 38 can build up a current mirror 53. A source terminal of the NMOS transistor 36 can output a signal to drive the dynamic bias circuit 220.

In the dynamic bias circuit 220, a MOS transistor 73 acts as a source follower which is coupled to the output terminal of the error amplifier 210. NMOS transistors 71 and 72 can form a current mirror. Similarly, PMOS transistors 75 and 76, and a PMOS transistor 74 and a PMOS transistor 91 in the pass device 230 form two separate current mirrors, respectively. The pass device 230 can be the PMOS transistor 91. A gate terminal of the MOS transistor 91 can sense the variation of the output current at the rail 14 which will be further described below. Finally, the PMOS transistor 91 provides an output voltage $V_{OUT}$ with driving capacity, for example, the PMOS transistor 91 can output approximately a current of 130 mA at the rail 14 that supplies the power to the external load.

Traditionally, a load capacitor with an equivalent serial resistance (ESR) (not shown) is coupled in parallel with the external load, and it is connected between an output terminal of the voltage regulator and the ground. In this embodiment, $I_C$ is defined as a current flowing through the load capacitor, and $I_{LOAD}$ indicates another current flowing through the external load. The output current, $I_{OUT}$, is equal to the sum of $I_C$ and $I_{LOAD}$. In a transient condition, if the load current $I_{LOAD}$ increases, the load capacitor will discharge so as to charge the external load. Consequently, the output voltage $V_{OUT}$ will decrease instantly, and the feedback voltage $V_{RB}$ in line 16 will decrease proportionally. The output voltage of the error amplifier 210 will become smaller as $V_{RB}$ decreases. A voltage $V_G$ of the gate terminal of the PMOS 91 will decrease correspondingly since the gate terminal is discharged along the line 17. The output current $I_{OUT}$ then can become larger as the $V_G$ decreases. Therefore, the increased output current can charge the load capacitor and the output voltage $V_{OUT}$ will increase to a predetermined value.

In opposition, if the load current $I_{LOAD}$ decrease, the load capacitor can be charged such that the output voltage $V_{OUT}$ can become larger. In a transient condition, the output current remains larger than the $I_{LOAD}$. The output current is mirrored by the MPOS transistor 74. After the mirrored current flowing through the NMOS transistor 72, the mirrored current from the PMOS transistor 74 can be mirrored by the NMOS transistor 71. In the same way, a larger mirrored current is provided at PMOS 75. The larger mirrored current can charge the gate terminal of the PMOS transistor 91. As the voltage $V_G$ increases rapidly, the output voltage $V_{OUT}$ reduces to the predetermined value accordingly and the output current at the rail 14 can quickly return to a smaller value based on the increasing voltage $V_G$. Therefore, the voltage $V_G$ can vary quickly according to the load current and the slew rate for a gate voltage of the pass device 230 is greatly improved.

A resistive divider is employed as the feedback circuit 240. The resistive divider includes a first resistor 92 and a second resistor 93 coupled in series. The resistors 92 and 93 can scale down the output voltage $V_{OUT}$ in rail 14 according to different values of resistors 92 and 93 and feed a voltage lower than the $V_{OUT}$ back to a gate terminal of the MOS transistor 32. As shown, the resistors 92 and 93 can implement a feedback system for the voltage regulator system and the feedback voltage can be adjusted by selecting different values for the resistor 92 and 93.

The compensation circuit 250 includes a Miller compensation capacitor 94. The compensation circuit 250 is coupled between the output voltage $V_{OUT}$ and a gate terminal of MOS transistors 33 and 34. The compensation circuit 250 basically provides a compensation to ensure the voltage regulator 20 outputs a relatively stable $V_{OUT}$ utilizing the Miller effect.

The insertion of the compensation circuit 150 in FIG. 1 and the compensation circuit 250 in FIG. 2 may cause two poles to appear in a right-half plane as a pair of complex poles under certain conditions. The movement of the poles can cause the output voltage $V_{OUT}$ not to be stable. In addition, the circuitry in FIG. 1 and in FIG. 2 may not have desirable phase margin and gain margin in frequency characteristic plots while the load condition varies in a large scale. The undesirable phase margin and gain margin can adversely affect stability of the circuitry in FIG. 1 and FIG. 2. All the disadvantages in FIG. 1 and FIG. 2 can be improved using the principle of the invention as described herein.

Figure 3:
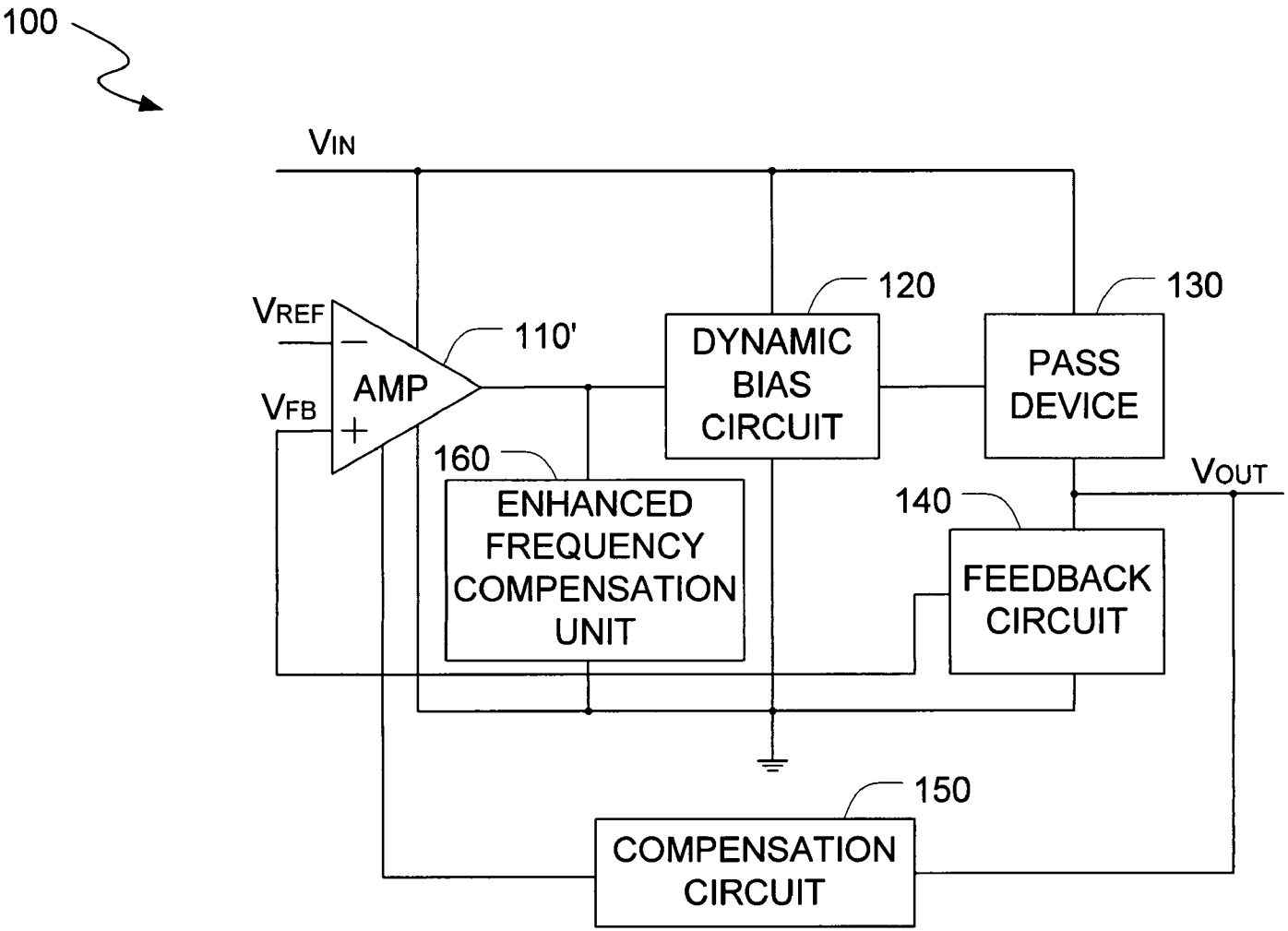
FIG. 3 is a block diagram of a LDO voltage regulator according to one embodiment of the invention.
Figure 4:
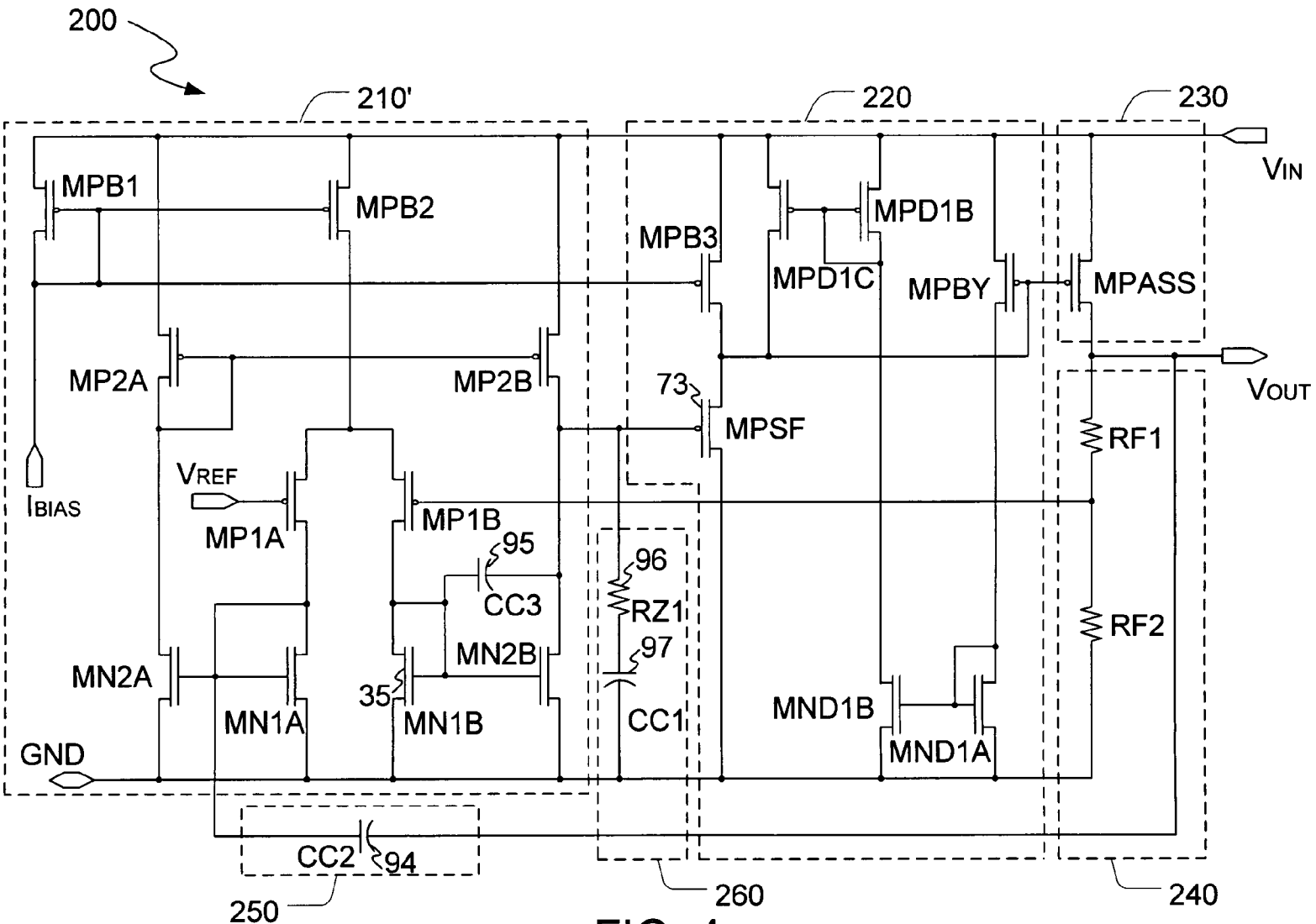
FIG. 4 is a schematic diagram of the LDO voltage regulator of FIG. 3.

The symbols in FIG. 3 and FIG. 4 are similar to those in FIG. 1 and FIG. 2 respectively, and the similar functions of the same components will be omitted herein for clarity. Only the difference and improvement will be further described in details as following.

FIG. 3 illustrates a block diagram of a LDO voltage regulator 100 in accordance with the invention which provides enhanced frequency compensation. Unlike the voltage regulator in FIG. 1, the voltage regulator 100 can include an error amplifier 110' and an enhanced frequency compensation unit 160. The amplifier 110' further includes a damping factor regulating circuit (such as a compensation capacitor 93 shown in FIG. 4). The enhanced frequency compensation unit 160 is coupled to the output terminal of the error amplifier 110' and the input terminal of the dynamic bias circuit 120. The enhanced frequency compensation unit 160 is used to provide a zero reference value, which can greatly improve stability of the voltage regulator 100.

The enhanced frequency compensation unit 160 can provide an internal zero (i.e. a zero reference value) to influence movement of poles given by a system transfer function of the voltage regulator 100. Therefore, the enhanced frequency compensation unit 160 can greatly improve stability of the voltage regulator system and provide a stable voltage $V_{OUT}$. The advantages of the enhanced frequency compensation unit 160 will be further described in details herein compared with FIG. 1 and FIG. 2.

Figure 5:
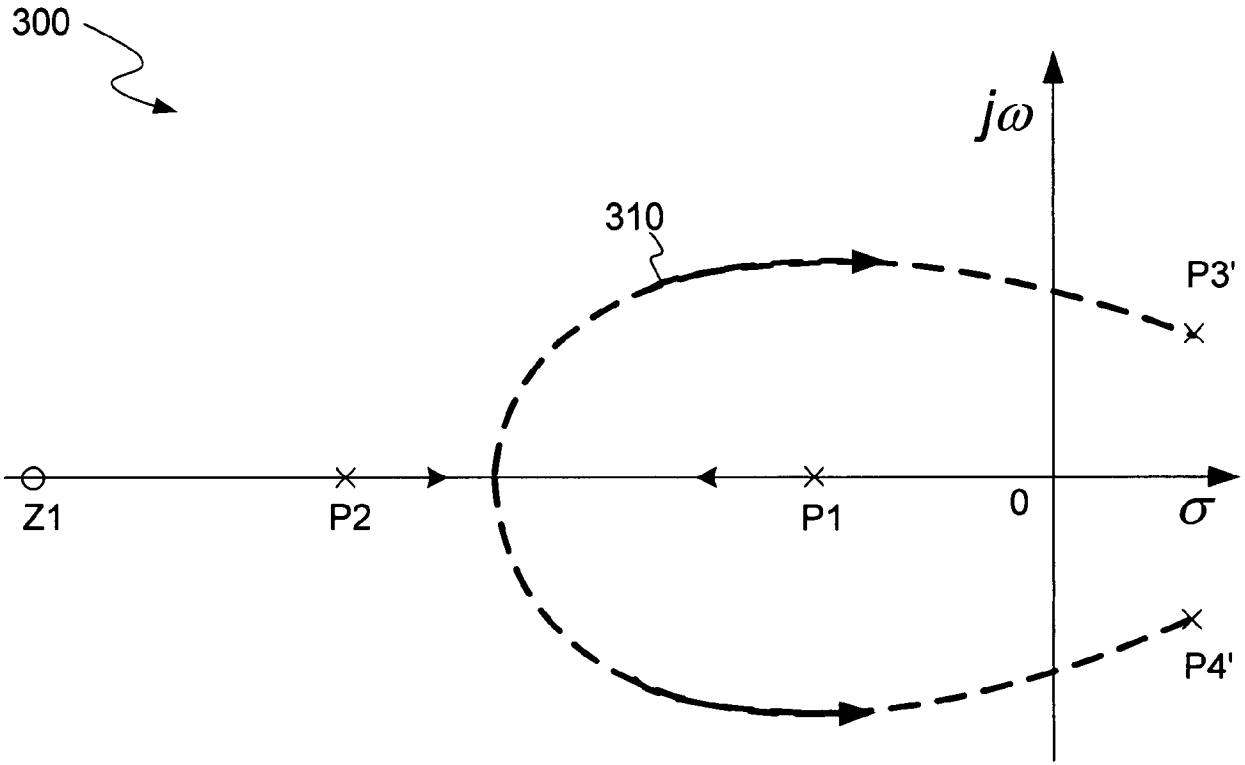
FIG. 5 is a diagram of root locus in accordance with system transfer functions.

With reference to FIG. 5, a root locus diagram 300 is shown only to further illustrate the principle of the voltage regulator 100 in FIG. 3. Conventionally, at least two poles, such as poles P1 and P2, can be given from a system transfer function of the voltage regulator system. The voltage regulator 100 includes an AC close-loop formed by the insertion of the compensation circuit 150. As described above, the configuration of a Miller compensation capacitor in the compensation circuit 150 can cause pole movement. As a result, the poles P1 and P2 may move along an arrow direction shown in FIG. 5 under certain conditions. When the poles P1 and P2 meet, a pair of complex poles may generate and move along with an arrow direction in curve 310 which may cause the poles to appear in a right-hand plane, such as P3' and P4'. In this condition, the voltage regulator system is in an unstable condition and cannot output a stable output voltage.

Therefore, the enhanced frequency compensation unit 160 is needed to compensate the instability resulting from the right-hand plane poles. The enhanced frequency compensation unit 160 can insert an internal zero in higher frequency in the system transfer function, which can prevent the poles P1 and P2 from appearing in the right-hand plane. The generation of the internal zero can prevent the poles P1 and P2 from meeting together and moving to the right-hand plane. Consequently, the poles P1 and P2 are enforced to remain in a left-hand plane with influence of the enhanced frequency compensation unit 160 because the value of the poles P1 and P2 are negative. Further, the locations of the poles P1 and P2 are determined by the specific requirement of frequency compensation.

Additionally, a damping factor generated by the compensation circuit 150 can be small in some conditions, thus, an undesirable frequency peak can occur. The small damping factor can cause the frequency peak to appear near to or above a unity-gain frequency of the voltage regulator 20. The frequency peak can also decrease a gain margin and a phase margin of the open-loop frequency response. However, the compensation capacitor in the error amplifier 110' can further regulate the damping factor. The compensation capacitor can also slightly compensate the output voltage $V_{OUT}$.

Turning to FIG. 4, a schematic diagram of an exemplary voltage regulator 200 is illustrated. The voltage regulator 200 is implemented according to the principles described in FIG. 3. In one embodiment, the voltage regulator 200 can further include an error amplifier 210' and an enhanced frequency compensation unit 260. The error amplifier 210' includes a compensation capacitor CC3 95 acting as the damping factor regulating circuit. The compensation capacitor CC3 95 is coupled to a source terminal and a gate terminal of the NMOS transistor 35, and to a gate terminal of the PMOS transistor 73. The enhanced frequency compensation unit 260 includes a resistor RZ1 96 and a capacitor CC1 97 coupled in series. The resister 96 and the capacitor 97 can generate the internal zero in higher frequency. The internal zero can advantageously impact on the movement of one of the poles, P1 or P2, so as to ensure all the poles can remain in the left-hand plane. Consequently, enhanced frequency compensation can be implemented with the resistor 96 and the capacitor 97. The values of the resistor 96 and the capacitor 97 are determined by different requirements of specific compensation effects. The value of the internal zero, such as Z1 shown in FIG. 5 is given by an equation (1):

$$Z1 = \frac{1}{RZ1 \cdot CC1} \tag{1}$$

The frequency of the zero Z1 is given by an equation (2):

$$f_{Z1} = \frac{1}{2\pi \cdot RZ1 \cdot CC1} \tag{2}$$

Although the capacitor CC3 is represented in FIG. 4, those skilled in the art will appreciate other kinds of components may also be used, for example, a poly capacitor and a MOS transistor. Similarly, even though the resistor RZ1 96 and the capacitor CC1 97 are shown in this embodiment, it is obvious to those skilled in the art that other configurations can also be used to insert an internal zero without departing from the spirit of the present invention. In some conditions, two MOS transistors can realize the function of inserting the internal zero. Other structures, such as a resistor and a MOS transistor, a MOS transistor and a capacitor can also be utilized in some specific application. In addition, the type of various MOS transistors in FIG. 4 is not fixed. There are other alternatives to the MOS transistors for this embodiment. Other type and other combination of transistors can be employed to implement the function of the error amplifier 210', the dynamic bias circuit 220 and the pass device 230 without departing the spirit of the present invention.

Figure 6:
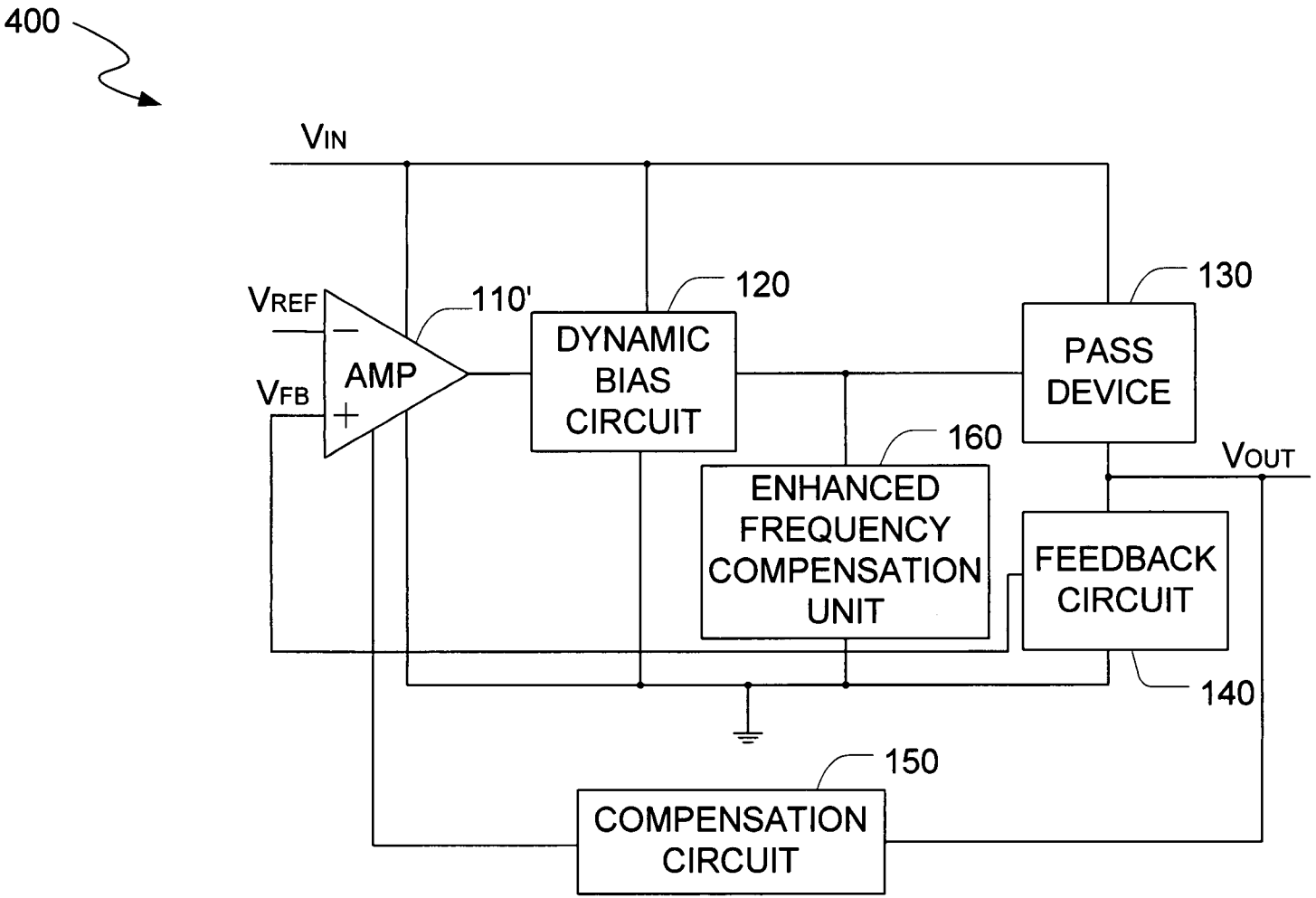
FIG. 6 is a block diagram of a LDO voltage regulator according to an alternative embodiment of the invention.

It is obvious to those skilled in the art that the location where the enhanced frequency compensation unit 160 is added is not fixed. The location of the enhanced frequency compensation unit 160 depends on requirements of the integrated circuitry. Turning to FIG. 6, another embodiment of a LDO voltage regulator 400 is shown. The enhanced frequency compensation unit 160 can be coupled to the output terminal of the dynamic bias circuit 120 and the input terminal of the pass device 130, which can also obtain desirable results.

It is also obvious to those skilled in the art that the damping factor regulating circuit included in the error amplifier 110' in FIG. 3 and FIG. 6 can be connected in other positions. For example, the damping factor regulating circuit can be connected between the input terminal and the output terminal of the pass device 130 to optimize compensation.

Figure 7A:
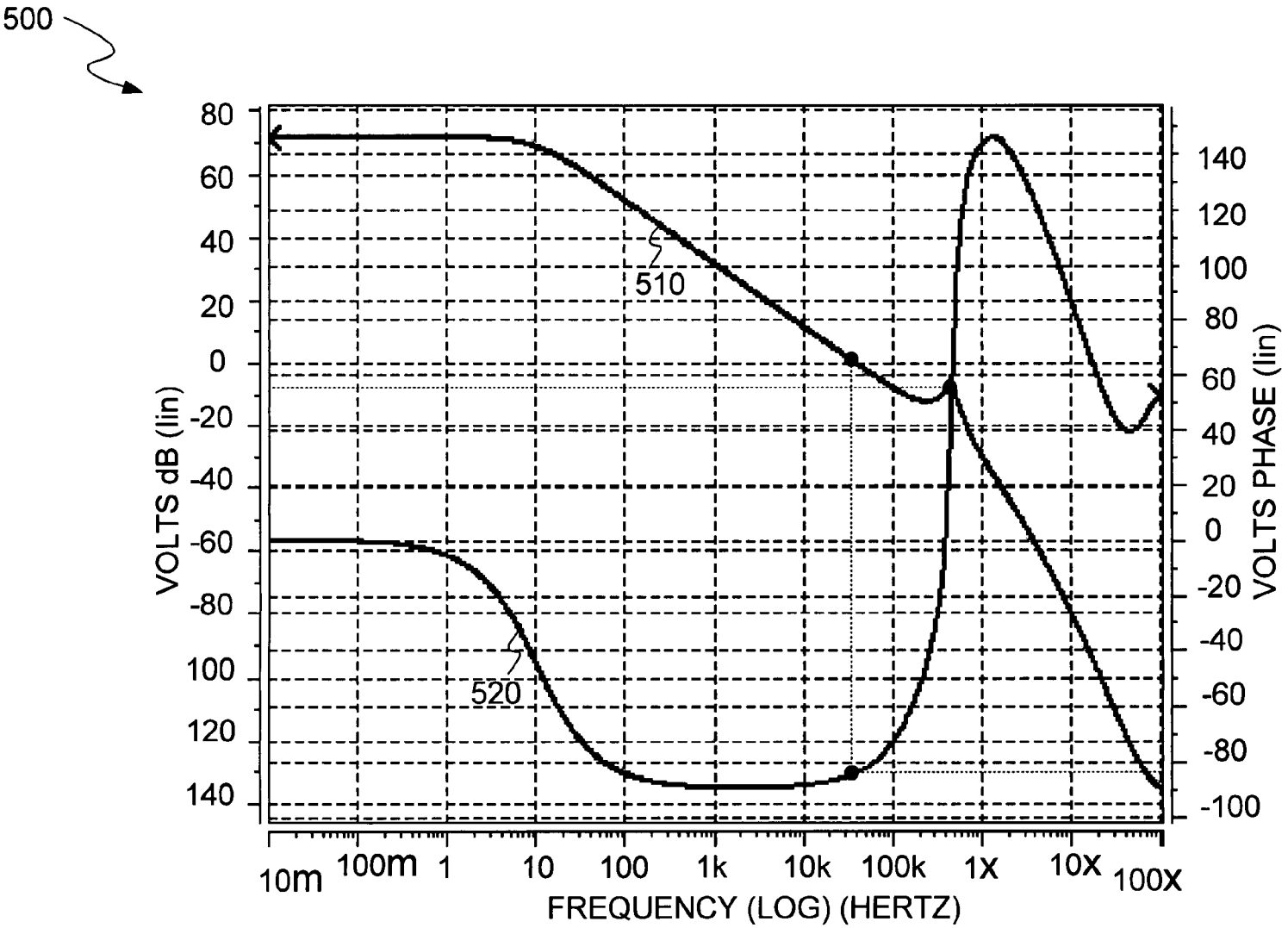
FIG. 7A is a simulation chart of the LDO voltage regulator of FIG. 2.
Figure 7B:
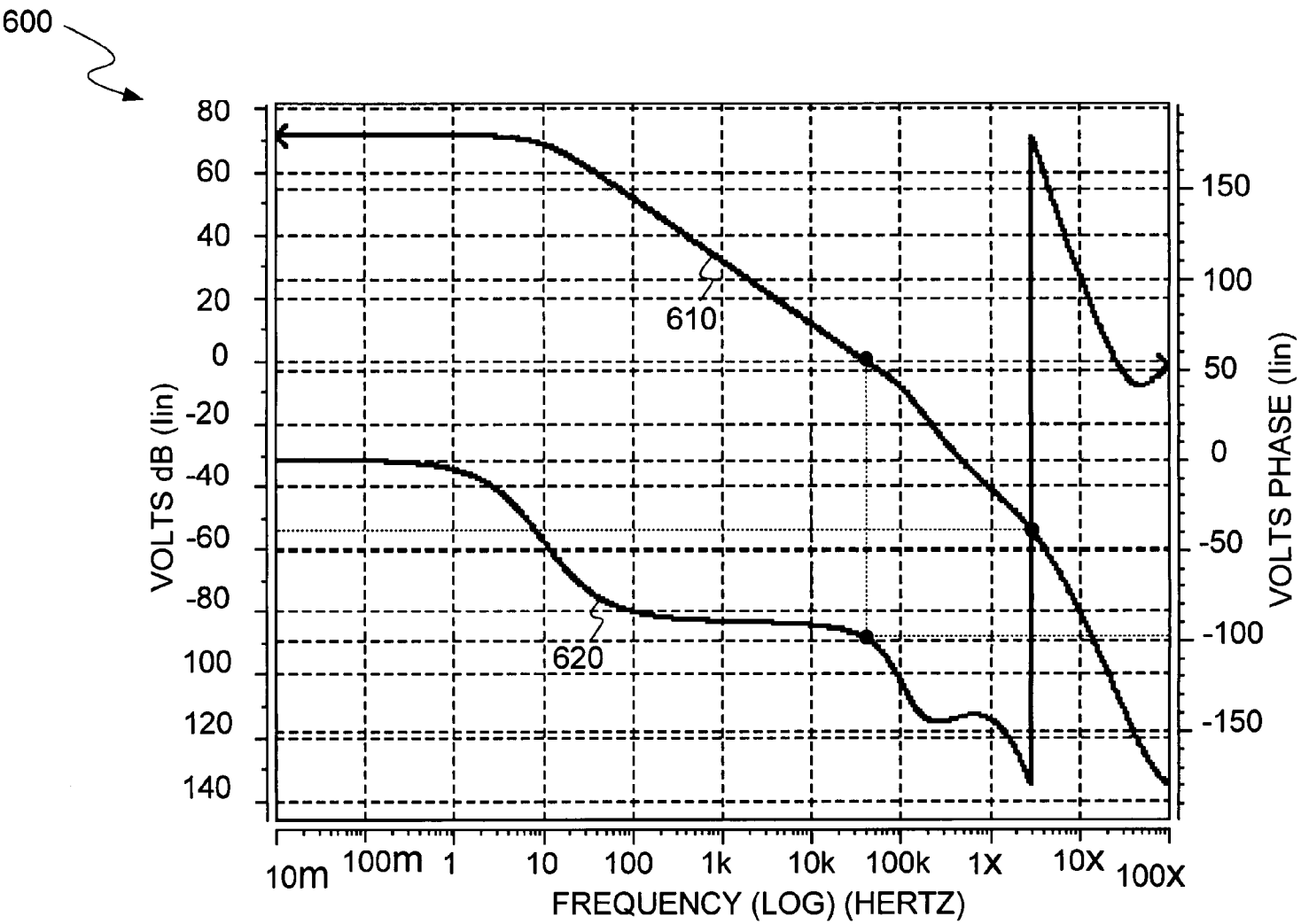
FIG. 7B is a simulation chart of the LDO voltage regulator of FIG. 4.

For further understanding of the principle of the present invention, FIG. 7A and FIG. 7B show exemplary results from the LDO voltage regulators 20 and 200 in the above embodiments. Some requirements are needed to ensure the voltage regulator system to output a stable voltage. The first requirement is all poles should appear in a left-hand plane. If at least one pole shows in a right-hand plane, the voltage regulator system cannot be stable because of oscillation of the voltage regulator system. Secondly, the open-loop transfer function should provide reasonable frequency response characteristics based on stability of the voltage regulator system. One of the frequency response characteristics is that the open-loop transfer function should give a desirable gain margin to the open-loop frequency response. Typically, the gain margin can be less than approximately −12 dB for a LDO voltage regulator. Another frequency response characteristic is that the open-loop transfer function should provide a phase margin to an open-loop frequency response. The phase margin generally can be more than about 45 degree.

Turning to FIG. 7A, an open-loop frequency response Bode plot 500 of the voltage regulator 20 is illustrated from experiment results of one embodiment. As illustrated above, the voltage regulator 20 is a LDO voltage regulator with the Miller compensation capacitor 94. Curve 510 is an amplitude-frequency characteristic plot, and curve 520 is a phase-frequency characteristic plot. Chart 1A below also illustrates corresponding results of poles and zeros of the voltage regulator 20 simulated by a software (not shown) for a specific value of loads.

Turning to Chart 1A, two complex poles, for example (71.9061K, −463.6408k) and (71.9061K, 463.6408k) can appear in the right-hand plane, although the Miller compensation capacitor 94 is provided. Thus, the voltage regulator 20 cannot output the stable voltage signal $V_{OUT}$.

CHART 1A

| poles (hertz) | | zero (hertz) | |
|---|---|---|---|
| real | imag | real | imag |
| −56.5565m | 0. | −56.5597m | 0. |
| −10.2741 | 0. | −142.2900k | 0. |
| 71.9061k | −463.6408k | −338.6275k | 0. |
| 71.9061k | 463.6408k | −914.0924k | 0. |

With reference to FIG. 7B, an open-loop frequency response Bode plot 600 is shown for the voltage regulator 200. The Bode plot 600 is also made from experiment results of one embodiment. In FIG. 7B, curve 610 is an amplitude-frequency characteristic, and curve 620 is a phase-frequency characteristic. The voltage regulator 200 is a LDO voltage regulator with the compensation capacitor 94 and the enhanced frequency compensation unit 260.

In this embodiment of FIG. 7B, a value of the gain margin may be approximately −55 dB. A value of the phase margin is about 90 degree (i.e. (180–95)). Both the gain margin and the phase margin can fall in the requirements of stability for the voltage regulator system.

All the poles are located in the left-hand plane which can prevent the voltage regulator 200 from entering into oscillations. Therefore, the experiment results can meet all the requirements for system stability.

In operation, the LDO voltage regulator circuit 200 can receive a DC input signal $V_{IN}$ and export a stable DC output voltage $V_{OUT}$ based on different requirements of a plurality of applications. During the enhanced frequency compensation procedure, the error amplifier 210' in the voltage regulator circuit 200 can compare a reference signal $V_{REF}$ and a feedback signal $V_{RB}$ transmitted from the feedback circuit 240, and providing an amplified difference value at its output terminal.

The dynamic bias circuit 220 can sense the output current of the voltage regulator circuit 200. The dynamic bias circuit 220 can charge or discharge the gate terminal of the pass device 230 according to the variation of the output current. The charging and discharging of the gate terminal greatly improve the slew rate for the gate voltage of the pass device 230. Additionally, the pass device 230 is driven into a linear operation region, thus reducing the die size of the integrated circuit. The pass device 230 can provide a stable output voltage and output current that supply power to various loads of large-scale.

The feedback circuit 140 can provide a proportional voltage such that a close-loop configuration is formed in the voltage regulator. With the compensation circuit 150 and the enhanced frequency compensation unit 160, the voltage regulator circuit 100 can be ensured to obtain a stable voltage which also can be less influenced by the loads.

The embodiments that have been described herein are some of the several possible embodiments that utilize this invention and they are described here by way of illustration and not of limitation. It is obvious that many other embodiments, which will be readily apparent to those skilled in the art, may be made without departing materially from the spirit and scope of the invention as defined in the appended claims. Furthermore, although elements of the invention may be described or claimed in the singular, the plural is contemplated unless limitation to the singular is explicitly stated.

What is claimed is:

1. A low drop-out (LDO) voltage regulator circuit with enhanced frequency compensation, comprising:

an error amplifier for generating an amplified error voltage having a first input terminal for receiving a reference voltage, a second input terminal for receiving a feedback voltage, a third input terminal, and an output terminal;

a dynamic bias circuit having an input terminal and an output terminal, the input terminal of the dynamic bias circuit being connected to the output terminal of the error amplifier;

an enhanced frequency compensation unit for generating a zero reference value, the enhanced frequency compensation unit being connected between the output terminal of the error amplifier and the ground;

a pass device having an input terminal and an output terminal for providing an output voltage to drive a plurality of external components, the input terminal of the pass device being connected to the output terminal of the dynamic bias circuit; and a feedback circuit for scaling down the output voltage, the feedback circuit having a first terminal and a second terminal, the first terminal of the feedback circuit being connected to the output terminal of the pass device, the second terminal of the feedback circuit being connected to the second input terminal of the error amplifier.

2. The LDO voltage regulator circuit of claim 1, further comprising a compensation circuit having a first terminal and a second terminal for providing compensation to the output voltage, the first terminal of the compensation circuit being connected to the output terminal of the pass device, and the second terminal being connected to the third input terminal of the error amplifier.

3. The LDO voltage regulator circuit of claim 1, wherein the error amplifier further comprises a damping factor regulating circuit to optimize compensation.

4. The LDO voltage regulator circuit of claim 3, wherein the damping factor regulating circuit comprises a capacitor.

5. The LDO voltage regulator circuit of claim 3, wherein the damping factor regulating circuit comprises a metal oxide semiconductor (MOS) transistor.

6. The LDO voltage regulator circuit of claim 1, wherein further comprising a damping factor regulating circuit coupled between the input terminal and the output terminal to optimize compensation.

7. The LDO voltage regulator circuit of claim 6, wherein the damping factor regulating circuit comprises a capacitor.

8. The LDO voltage regulator circuit of claim 6, wherein the damping factor regulating circuit comprises a metal oxide semiconductor (MOS) transistor.

9. The LDO voltage regulator circuit of claim 1, wherein the enhanced frequency compensation unit comprises a resistor and a capacitor coupled in series.

10. The LDO voltage regulator circuit of claim 1, wherein the enhanced frequency compensation unit comprises a MOS transistor and a resistor coupled in series.

11. The LDO voltage regulator circuit of claim 1, wherein the enhanced frequency compensation unit comprises a MOS transistor and a capacitor coupled in series.

12. The LDO voltage regulator circuit of claim 1, wherein the enhanced frequency compensation unit comprises two MOS transistors coupled in series.

13. A low drop-out (LDO) voltage regulator circuit with enhanced frequency compensation, comprising:

an error amplifier for generating an amplified error voltage having a first input terminal for receiving a reference voltage; a second input terminal for receiving a feedback voltage, a third input terminal, and an output terminal;

a dynamic bias circuit having an input terminal and an output terminal, the input terminal of the dynamic bias circuit being connected to the output terminal of the error amplifier;

an enhanced frequency compensation unit for generating a zero reference value, the enhanced frequency compensation unit being connected between the output terminal of the dynamic bias circuit and the ground;

a pass device having an input terminal and an output terminal for providing an output voltage to drive a plurality of external components, the input terminal of the pass device being connected to the output terminal of the dynamic bias circuit; and a feedback circuit for scaling down the output voltage, the feedback circuit having a first terminal and a second terminal, the first terminal of the feedback circuit being connected to the output terminal of the pass device, the second terminal of the feedback circuit being connected to the second input terminal of the error amplifier.

14. The LDO voltage regulator circuit of claim 13, further comprising a compensation circuit having a first terminal and a second terminal for providing compensation to the output voltage, the first terminal of the compensation unit being connected to the output terminal of the pass device, and the second terminal being connected to the third input terminal of the error amplifier.

15. The LDO voltage regulator circuit of claim 13, wherein the error amplifier further comprises a damping factor regulating circuit to optimize compensation.

16. The LDO voltage regulator circuit of claim 15, wherein the damping factor regulating circuit comprises a capacitor.

17. The LDO voltage regulator circuit of claim 15, wherein the damping factor regulating circuit comprises a MOS transistor.

18. The LDO voltage regulator circuit of claim 13, wherein further comprising a damping factor regulating circuit coupled between the input terminal and the output terminal to optimize compensation.

19. The LDO voltage regulator circuit of claim 18, wherein the damping factor regulating circuit comprises a capacitor.

20. The LDO voltage regulator circuit of claim 18, wherein the damping factor regulating circuit comprises a metal oxide semiconductor (MOS) transistor.

21. The LDO voltage regulator circuit of claim 13, wherein the enhanced frequency compensation unit comprises a resistor and a capacitor coupled in series.

22. The LDO voltage regulator circuit of claim 13, wherein the enhanced frequency compensation unit comprises a MOS transistor and a resistor coupled in series.

23. The LDO voltage regulator circuit of claim 13, wherein the enhanced frequency compensation unit comprises a MOS transistor and a capacitor coupled in series.

24. The LDO voltage regulator circuit of claim 13, wherein the enhanced frequency compensation unit comprises two MOS transistors coupled in series.

25. A method for frequency compensation an output voltage in a low drop-out voltage regulator circuit with enhanced frequency compensation capacity, comprising the steps of:

generating an amplified voltage;

receiving the amplified voltage at a dynamic bias circuit;

generating a first output voltage at the dynamic bias circuit;

driving a pass device with the first output voltage;

increasing a slew rate for a gate voltage of the pass device through use of the dynamic bias circuit;

receiving a second output voltage from the pass device;

generating a zero reference value to stabilize the second output voltage; and regulating a damping factor to further stabilize the second output voltage.

26. The method of claim 25, further comprising the steps of:

receiving a reference voltage; and receiving a feedback voltage in proportion with the second output voltage, where the reference voltage and the feedback voltage being used to generate the amplified voltage.

* * * * *

UNITED STATES PATENT AND TRADEMARK OFFICE

CERTIFICATE OF CORRECTION

PATENT NO. : 7,218,083 B2
APPLICATION NO. : 11/135180
DATED : May 15, 2007
INVENTOR(S) : Wang et al.

It is certified that error appears in the above-identified patent and that said Letters Patent is hereby corrected as shown below:

On The Title Page; Item (73) Assignee should read
--Assignee: O2Micro, Inc., Grand Cayman (KY)--.

Signed and Sealed this

Seventeenth Day of July, 2007

JON W. DUDAS
*Director of the United States Patent and Trademark Office*